United States Patent [19]

Paulin, Sr.

[11] 4,200,069

[45] Apr. 29, 1980

[54] AUTOMATIC CHOKE

[76] Inventor: Kenneth L. Paulin, Sr., RFD #7, Augusta, Me. 04330

[21] Appl. No.: 878,508

[22] Filed: Feb. 17, 1978

[51] Int. Cl.[2] ..... F02M 1/10

[52] U.S. Cl. ..... 123/119 F

[58] Field of Search ..... 123/119 F

[56] References Cited

U.S. PATENT DOCUMENTS

| | | | |
|---|---|---|---|
| 2,694,558 | 11/1954 | Jorgensen et al. | 123/119 F |
| 2,837,071 | 6/1958 | Eckert et al. | 123/119 F |
| 3,120,841 | 2/1964 | Boller | 123/119 F |

*Primary Examiner*—Wendell E. Burns

*Attorney, Agent, or Firm*—Daniel Jay Tick

[57] ABSTRACT

The housing is affixed to the carburetor of a vehicle and interposed in the heater hose of the vehicle so that radiator fluid flowing through the hose flows through the housing. A thermal member of the housing has a plurality of thermal fins extending therefrom concentrating heat from fluid flowing through the housing. A bimetallic spiral spring is affixed at one end to a shaft rotatably mounted in the thermal member in the housing and is wound around the shaft at the thermal member. The spring is coupled to the choke of the vehicle in the carburetor whereby the choke is controlled by the condition of the spring which depends upon the temperature of fluid flowing through the hose.

4 Claims, 3 Drawing Figures

AUTOMATIC CHOKE

BACKGROUND OF THE INVENTION

The present invention relates to an automatic choke. More particularly, the invention relates to an automatic choke for an automotive vehicle having a heater hose for conducting radiator fluid and a carburetor including a choke.

Automatic chokes are described in the following United States patents. U.S. Pat. No. 2,511,318, issued to Beard on June 13, 1950, U.S. Pat. No. 2,624,325, issued to Fricke et al on Jan. 6, 1953, U.S. Pat. No. 2,702,536, issued to Carlson on Feb. 22, 1955, U.S. Pat. No. 2,992,641, issued to Sarto on July 18, 1961, U.S. Pat. No. 3,120,841, issued to Boller on Feb. 11, 1964, U.S. Pat. No. 3,198,185, issued to Nastas on Aug. 3, 1965, U.S. Pat. No. 3,230,945, issued to Goodyear on Jan. 25, 1966 and U.S. Pat. No. 3,800,767, issued to Winkley on Apr. 2, 1974.

Objects of the invention provide an automatic choke of simple structure, which is inexpensive in manufacture, installed with facility and convenience in new and existing vehicles and functions efficiently, effectively and reliably, automatically in accordance with the operating temperature of the engine, as evidenced by the temperature of the fluid flowing through the heater hose.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
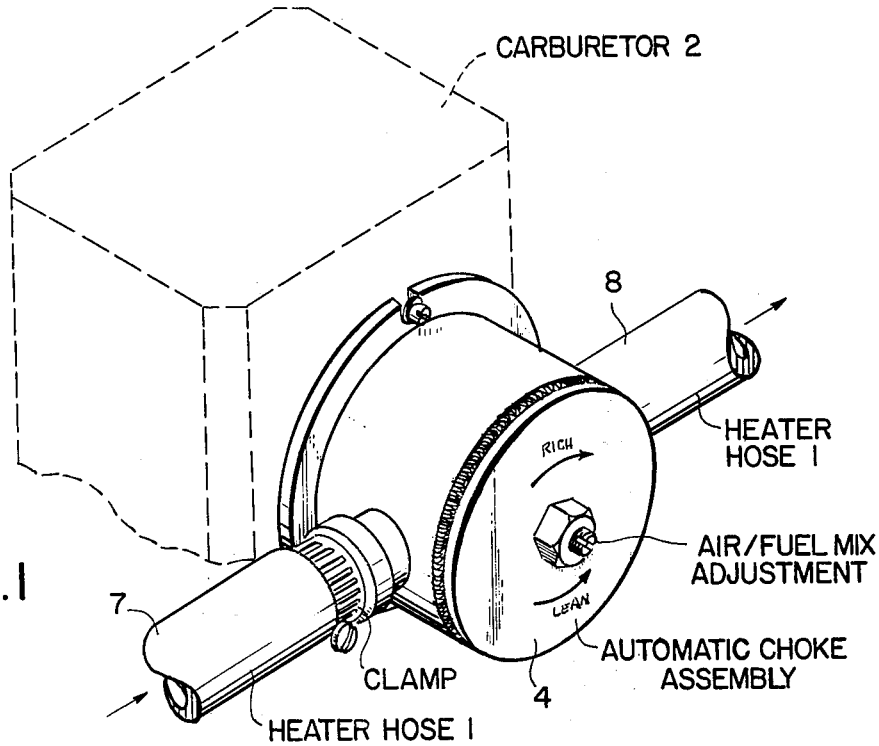
FIG. 1 is a perspective view of an embodiment of the automatic choke of the invention.
Figure 3:
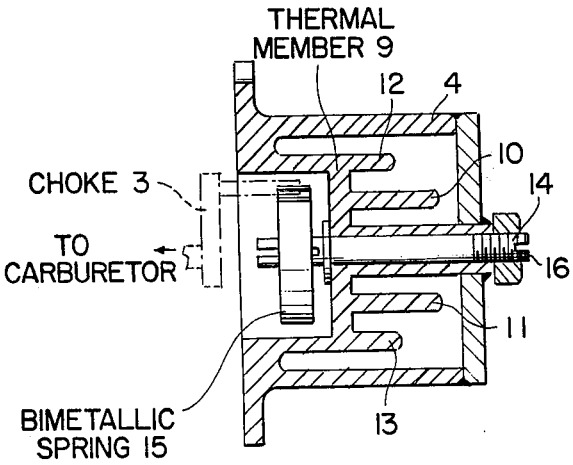
FIG. 3 is a view, partly in section taken along the lines III—III, of FIG. 2.

The automatic choke of the invention is for an automotive vehicle having a heater hose 1 for conducting radiator fluid (FIG. 1) and a carburetor 2 including a choke 3 (FIG. 3).

Figure 2:
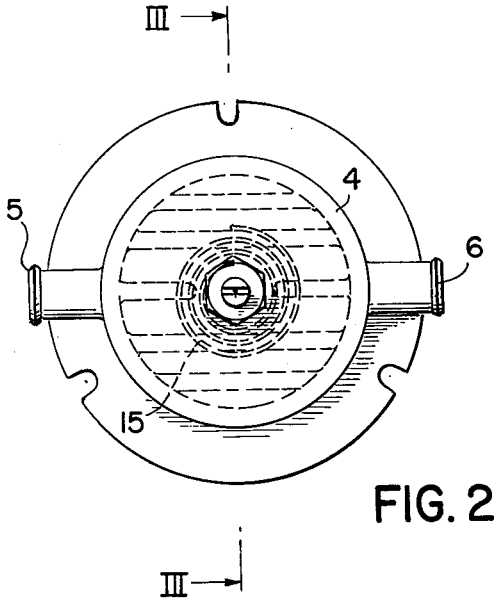
FIG. 2 is an axial view, on an enlarged scale, of the automatic choke of the invention.

The automatic choke of the invention comprises a housing 4 affixed to the carburetor 2 and having diametrically opposite holes 5 and 6 formed therethrough (FIG. 2). The housing 4 is interposed in the heater hose 1 so that a first part 7 of said hose is coupled to said housing at the hole 5 and a second part 8 of said hose is coupled to said housing at the hole 6, and radiator fluid flowing through said hose flows through said housing.

A thermal member 9 in the housing has a plurality of thermal fins 10, 11, 12 and 13 (FIG. 3) extending therefrom for concentrating heat of fluid flowing through the housing.

A shaft 14 (FIG. 3) is rotatably mounted in the thermal member 9 in the housing 4.

A bimetallic substantially spiral spring 15 (FIGS. 2 and 3) has one end affixed to the shaft 14 at the thermal member 9. As shown in FIG. 3, the bimetallic spring is coupled to the choke 3 of the vehicle in the carburetor 2 whereby the choke is controlled by the condition of said spring which depends upon the temperature of fluid flowing through the hose 1.

The shaft 14 extends from the housing 4 at one end 16 of said shaft, as shown in FIG. 3, and is adjustable in position via its extending part.

While the invention has been described by means of a specific example and in a specific embodiment, I do not wish to be limited thereto, for obvious modifications will occur to those skilled in the art without departing from the spirit and scope of the invention.

I claim:

1. An automatic choke for an automotive vehicle having a heater hose for conducting radiator fluid and a carburetor including a choke, said automatic choke comprising a housing affixed to the carburetor and having diametrically opposite holes formed therethrough, said housing being interposed in the heater hose so that a first part of said hose is coupled to said housing at one of said holes and a second part of said hose is coupled to said housing at the other of said holes and radiator fluid flowing through the hose flows through said housing, said housing having a front and a spaced substantially parallel back;

a thermal member in the housing having a plurality of thermal fins extending therefrom for concentrating heat of fluid flowing through said housing;

a shaft rotatably mounted in the thermal member in the housing, said shaft having spaced opposite first and second ends extending beyond the front and back, respectively, of said housing; and a bimetallic substantially spiral spring having one end affixed to the second end of said shaft outside said housing and wound around said shaft at the thermal member in a manner whereby said spring is surrounded by, but spaced from, radiator fluid flowing through said housing, said bimetallic spring being coupled to the choke of the vehicle in the carburetor whereby the choke is controlled by the condition of said spring which depends upon the temperature of fluid flowing through said hose.

2. An automatic choke as claimed in claim 1, wherein said shaft is adjustable in position via its first end extending beyond the front of said housing.

3. An automatic choke as claimed in claim 1, wherein the back of said housing has a recess formed therein in a manner whereby the area of the recess is completely surrounded by fluid flowing through said housing, and wherein said bimetallic spring is positioned in said recess.

4. An automatic choke as claimed in claim 2, wherein the first end of said shaft is threaded, and further comprising a lock nut threadedly coupled to said first end of said shaft outside said housing for rotatably securing said shaft in said housing.

* * * * *